US009715784B2

(12) United States Patent
Bennett

(10) Patent No.: US 9,715,784 B2
(45) Date of Patent: Jul. 25, 2017

(54) GAMING CONSOLE AND SYSTEM HAVING DYNAMIC FEATURE GAME

(75) Inventor: Nicholas Luke Bennett, Rosebery (AU)

(73) Assignee: Aristocrat Technologies Australia Pty Limited (AU)

( * ) Notice: Subject to any disclaimer, the term of this patent is extended or adjusted under 35 U.S.C. 154(b) by 1485 days.

(21) Appl. No.: 11/957,164

(22) Filed: Dec. 14, 2007

(65) Prior Publication Data

US 2008/0146309 A1 Jun. 19, 2008

Related U.S. Application Data

(63) Continuation of application No. 10/089,762, filed as application No. PCT/AU00/01191 on Sep. 29, 2000, now abandoned.

(30) Foreign Application Priority Data

Oct. 1, 1999 (AU) ..... PQ3238

(51) Int. Cl.
*A63F 9/24* (2006.01)
*G07F 17/32* (2006.01)

(52) U.S. Cl.
CPC ..... *G07F 17/3244* (2013.01); *G07F 17/32* (2013.01); *G07F 17/3267* (2013.01)

(58) Field of Classification Search
CPC ... G07F 17/32; G07F 17/3244; G07F 17/3267
USPC ..... 463/16–31, 46; 273/143 R, 141 R, 273/141 A, 138.1, 138.2, 139
See application file for complete search history.

(56) References Cited

U.S. PATENT DOCUMENTS

| | | | | |
|---|---|---|---|---|
| 5,393,057 | A | 2/1995 | Marnell | |
| 5,788,573 | A * | 8/1998 | Baerlocher et al. | 463/16 |
| 5,848,932 | A | 12/1998 | Adams | |
| 5,947,820 | A | 9/1999 | Morro | |
| 5,980,384 | A * | 11/1999 | Barrie | 463/16 |
| 6,159,097 | A * | 12/2000 | Gura | G07F 17/32 273/138.2 |
| 6,227,971 | B1 * | 5/2001 | Weiss | 463/20 |
| 6,311,976 | B1 * | 11/2001 | Yoseloff et al. | 273/138.2 |
| 6,375,567 | B1 * | 4/2002 | Acres | 463/25 |
| 6,699,122 | B1 * | 3/2004 | Osawa | 463/20 |

(Continued)

FOREIGN PATENT DOCUMENTS

AU 199878853 B2 2/1999

*Primary Examiner* — William H McCulloch, Jr.
*Assistant Examiner* — Chase Leichliter
(74) *Attorney, Agent, or Firm* — McAndrews, Held & Malloy, Ltd.

(57) ABSTRACT

A gaming console or system including a video display, and a game control processor arranged to control images displayed on the video display. The game control processor is arranged to play a first game displayed on the video display and, if a winning combination results, the console or system pays a prize. The console or system is characterized in that the game control processor includes a dynamic game feature whereby a feature game occurs upon a first trigger condition of the first game, and wherein a second trigger condition influences one or more gameplay aspects of the feature game such as to alter the likelihood of occurrence of at least one possible outcome of a set of possible outcomes of the feature game.

15 Claims, 6 Drawing Sheets

(56) References Cited

U.S. PATENT DOCUMENTS

| | | | | |
|---|---|---|---|---|
| 6,802,774 | B1 * | 10/2004 | Carlson et al. | 463/16 |
| 2002/0039918 | A1 * | 4/2002 | Anderson | A63F 9/183 463/16 |
| 2003/0027622 | A1 * | 2/2003 | Osawa | 463/20 |
| 2004/0048646 | A1 * | 3/2004 | Visocnik | G07F 17/32 463/16 |

* cited by examiner

GAMING CONSOLE AND SYSTEM HAVING DYNAMIC FEATURE GAME

RELATED APPLICATIONS

This application claims priority to and benefit as a continuation of U.S. patent application Ser. No. 10/089,762, filed on Jul. 22, 2002, entitled "Gaming Console and System Having Dynamic Feature Game," which claims priority to PCT Application No. PCT/AU99/01191, filed on Sep. 29, 2000, which in turn claims priority to Australian Application No. PQ 3238, filed on Oct. 1, 1999, each of which is herein incorporated by reference in its entirety.

INTRODUCTION

The present invention relates to gaming consoles of the type known as slot machines arranged to play a large variety of card related and other gambling games such as keno or bingo, and in particular the invention provides an improvement to a game played on such a machine.

DESCRIPTION OF THE PRIOR ART

Gaming or poker machines have been well known for many years and have more recently gained considerable popularity, with quite substantial amounts of money wagered on these machines. There is a growing tendency for State or National Governments to legalise the use of gaming machines by licensing operators, with resulting revenue gains through license fees and taxation of monies invested. The licensed operation of gaming machines is the subject of State legislation and regulation. This regulation most always dictates a minimum percentage payout for a gaming machine. For example, a minimum of 85% of monies invested must be returned as winnings, and manufacturers of gaming machines therefore must design their machines around these regulatory controls.

With the growth that has occurred in the gaming machine market there is intense competition between manufacturers to supply the various existing and new venues. When selecting a supplier of gaming machines, the operator of a venue will often pay close attention to the popularity of various games with their patrons. Therefore, gaming machine manufacturers are keen to devise games which are popular with players, as a mechanism for improving sales.

Many various strategies have been tried in the past to make games more enticing to players, including the commonly known double-up feature, whereby, if a player wins a particular game, they can then risk the winnings of that game in a double-or-nothing mode in which they gamble on a subsequent, and often different, game such as whether a red or black card will be the next card drawn.

Other techniques adopted in the past have been to provide complexity in the numbering and combinations of indicia which would result in a win, thereby hoping to convince the player that there is a greater chance of winning and to keep their interest in a particular game.

SUMMARY OF THE INVENTION

According to a first aspect the present invention provides a gaming console including a display means, and game control means arranged to control images displayed on the display means, the game control means being arranged to play a first game displayed on the display means and, if a winning combination results, the console pays a prize, the console being characterised in that the game control means includes a dynamic game feature whereby a feature game occurs upon a first trigger condition of the first game, and wherein a second trigger condition influences one or more gameplay aspects of the feature game such as to alter the likelihood of occurrence of at least one possible outcome of a set of possible outcomes of the feature game.

According to a second aspect the present invention provides a gaming console including a display means, and game control means arranged to control images displayed on the display means, the game control means being arranged to play a first game displayed on the display means and, if a winning combination results, the console pays a prize, the console being characterised in that the game control means includes a dynamic game feature whereby a feature game occurs upon a first trigger condition of the first game, and wherein a second trigger condition of the first game influences one or more gameplay aspects of the feature game such as to alter the likelihood of occurrence of at least one possible outcome of a set of possible outcomes of the feature game.

According to a third aspect the present invention provides a gaming system including at least one display means, and game control means arranged to control images displayed on each display means, the game control means being arranged to play a first game displayed on each display means and, if a winning combination results, the gaming system pays a prize, the gaming system being characterised in that the game control means includes a dynamic game feature whereby a feature game occurs upon a first trigger condition of the first game, and wherein a second trigger condition influences one or more gameplay aspects of the feature game such as to alter the likelihood of occurrence of at least one possible outcome of a set of possible outcomes of the feature game.

The first trigger condition may be the occurrence of a given symbol during the play of the first game, the occurrence of a given outcome of the first game, or the occurrence of a given event or sequence of events in the first game. Alternatively or additionally the first trigger condition may arise when a random number coincides with a number of credits bet per game, or may simply occur at random moments, or may be the occurrence of a player accumulation of a certain number of bonus points, or the first trigger condition may arise in a bonus game, the first game being the bonus game, which has come about during play on the console. The first trigger condition may come about in a different manner, as will be recognised by those skilled in the art. Similarly, the second trigger condition may be one or more of the above. The second trigger condition might even constitute a user selection of an aspect of the feature game, where the user selection could be made available upon the occurrence of the first trigger condition. In this instance, the user selection may be made on a display or screen or console separate to that of the first game.

The second trigger condition of the first game may influence one or more aspects of the feature game. For instance, the second trigger condition may increase the probability of the occurrence of a winning outcome of the feature game, or may increase or decrease the value of an available prize prior to or during play of the feature game. Other aspects of the feature game which the second trigger condition influences might be the number of winning opportunities in the feature game, the total number of possible outcomes of the feature game, or even the interaction of the feature game with other games. The second trigger condition may influence more than one or even all of the aspects of the feature game.

In other embodiments of the invention, there may be more than one type of first trigger condition and/or second trigger condition. In such embodiments, the type of first trigger condition which occurs may define the type of feature game which occurs. Similarly, the type of second trigger condition which occurs may alter the style of game played in the feature game, for instance by 'upgrading' the feature game to a different game in which there is a high likelihood of a winning outcome.

Preferably, the influence of the second trigger condition on the feature game is attractive to a user of the console or system, for example by being, or appearing to be, beneficial to the likelihood of a winning outcome. For instance, the second trigger condition may increase a prize value and/or increase the probability of occurrence of a winning outcome of the feature game. However, the present invention also encompasses embodiments in which the second trigger condition influences the feature game in a manner which is, or appears to be, detrimental to the likelihood of a winning outcome. For instance, the second trigger condition may be the occurrence of either a 'bad' wild card in the first game or a 'good' wild card in the first game, wherein the occurrence of the 'bad' wild card causes a probability of occurrence of a winning outcome in the feature game to be reduced. The second trigger condition in such embodiments may also alter a prize value in the feature game or may influence other aspects of the feature game.

Additionally, the second trigger condition may occur a plurality of times during the play of the first game. In this circumstance each occurrence of a second trigger condition in the first game may influence an aspect of the feature game. For instance, each occurrence of the second trigger condition may increment a number of winning opportunities in the feature game and/or decrement a total number of outcomes of the feature game, thereby increasing the probability of a winning outcome occurring in the feature game. Alternatively or additionally, the first game may be played a plurality of times before an outcome of the feature game is determined. In such embodiments, each occurrence of the second trigger condition preferably has a cumulative or individual influence on one or more aspects of the feature game.

In embodiments of the invention the first game may be of a style which creates a matrix of symbols and pays prizes for the occurrence of predetermined combinations in the matrix. In such embodiments, an occurrence of a given symbol or symbols in certain positions of the matrix may constitute the first or second trigger condition. For instance, the first game may pay a prize for the occurrence of a winning combination along certain 'paylines' in the matrix, wherein the occurrence of a winning combination along a given payline may constitute the first or second trigger condition.

In some embodiments of the invention the feature game may take the form of a 'spinning wheel' divided into a number of sectors, some of the sectors indicating a prize, wherein the feature game involves a user activating the wheel, and, after a random amount of time the wheel stops, whereby if a sector indicating a prize is situated adjacent to an indicator (which itself may be animated or fixed), the user wins the prize indicated by that sector. In such embodiments, the second trigger condition may increase the number of sectors indicating a prize, or may reduce the total number of sectors, alter the contents of one or more sectors, for instance adding a prize of certain value (such as $5, $10 . . . $100 etc) to a blank sector, or may even introduce a second or additional fixed or animated indicator. It is to be appreciated that the aspects of the feature game can be dynamic, and may change once, repeatedly, or even continuously. The indicator itself need not be fixed, and may move relative to the spinning wheel, in which case the wheel may remain motionless while the indicator moves. Alternatively the feature game may take the form of a board game, a game of dice, a bingo game, or a spinning reel game. It is to be appreciated that the first game and the feature game may be of a vast range of different styles.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS

In the following detailed description the methodology of the embodiments will be described, and it is to be understood that it is within the capabilities of the non-inventive worker in the art to introduce the methodology on any standard microprocessor-based gaming machine by means of appropriate programming.

Figure 1:
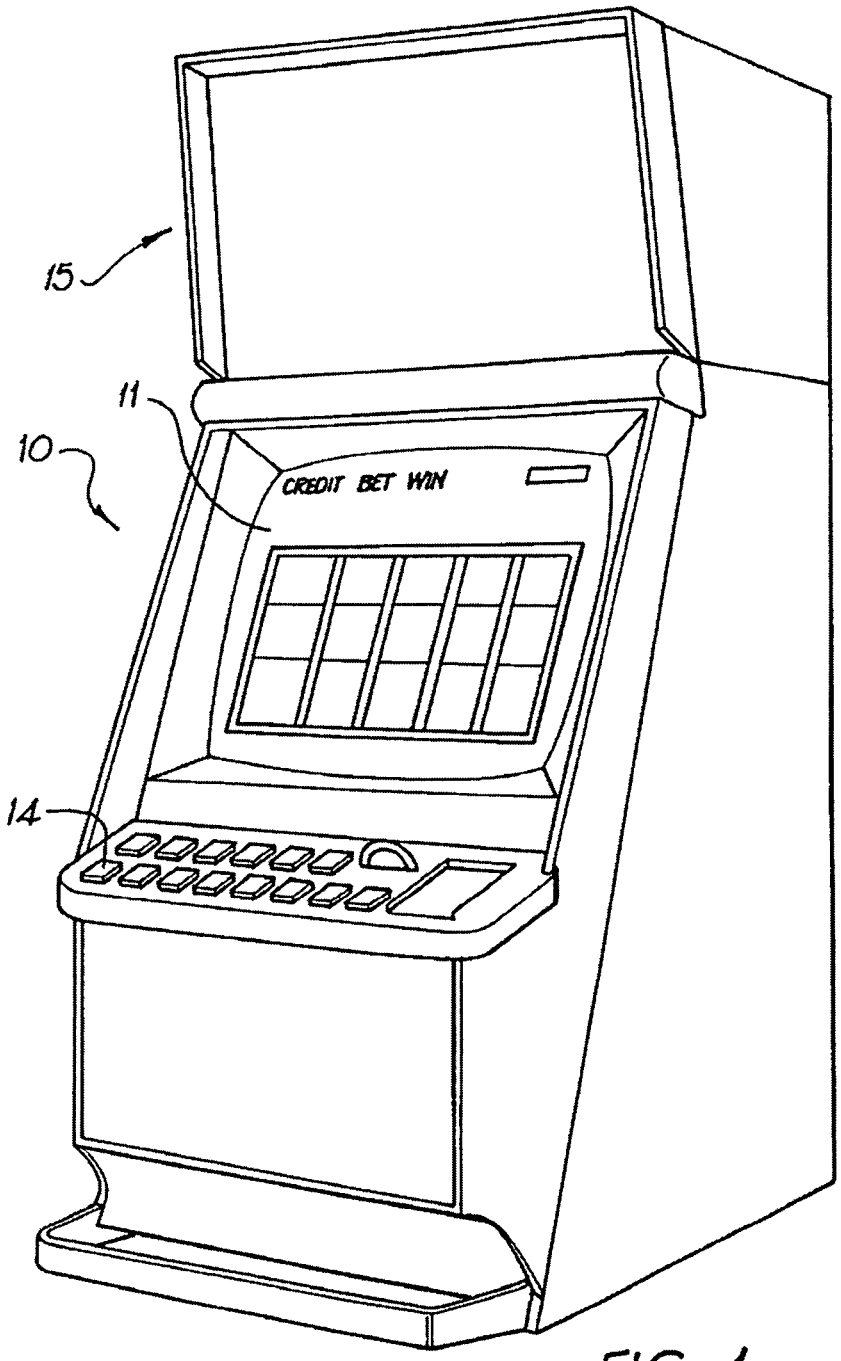
FIG. 1 illustrates a gaming console with a video simulation of a rotating reel display incorporating a first embodiment of the invention.

Referring to FIG. 1 of the drawings, a first embodiment of the invention is illustrated in which a slot machine 10, of the type having a video display screen 11 which displays a first game, in this instance including a plurality of rotatable reels 12 carrying symbols, is arranged to pay a prize on the occurrence of a predetermined symbol or combination of symbols.

In the slot machine 10 illustrated in FIG. 1, the game is initiated by a push button 14, however, it will be recognised by persons skilled in the art that this operating mechanism might be replaced by a pull handle or other type of actuator in other embodiments of the invention. The top box 15 on top of the slot machine 10 carries an artwork panel which displays the various winning combinations for which a prize is paid on this machine.

Figure 2:
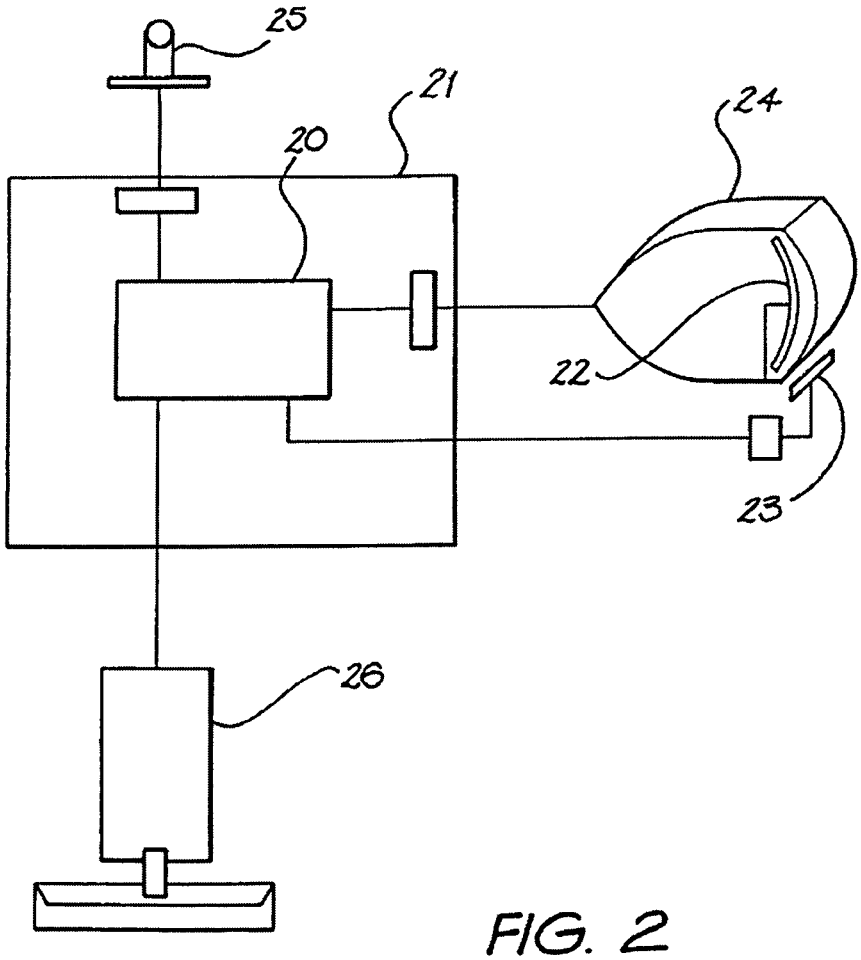
FIG. 2 is a schematic diagram of a gaming console control circuit.

The program which implements the game and game feature is run on a standard gaming machine control processor 20 as illustrated schematically in FIG. 2. The processor 20 forms part of a controller 21 which drives the video display screen 22 of the console 24 and receives input signals from sensors 23. The sensors 23 may be touch sensors, a pull handle or another type of actuator in other embodiments of the invention. The controller 21 also receives input pulses from a mechanism 25 indicating the user has provided sufficient credit to begin playing. The mechanism 25 may be a coin input chute, a credit card reader, or other type of validation device. The controller 21 further drives a payout mechanism 26 which for example may be a coin output.

Figure 3:
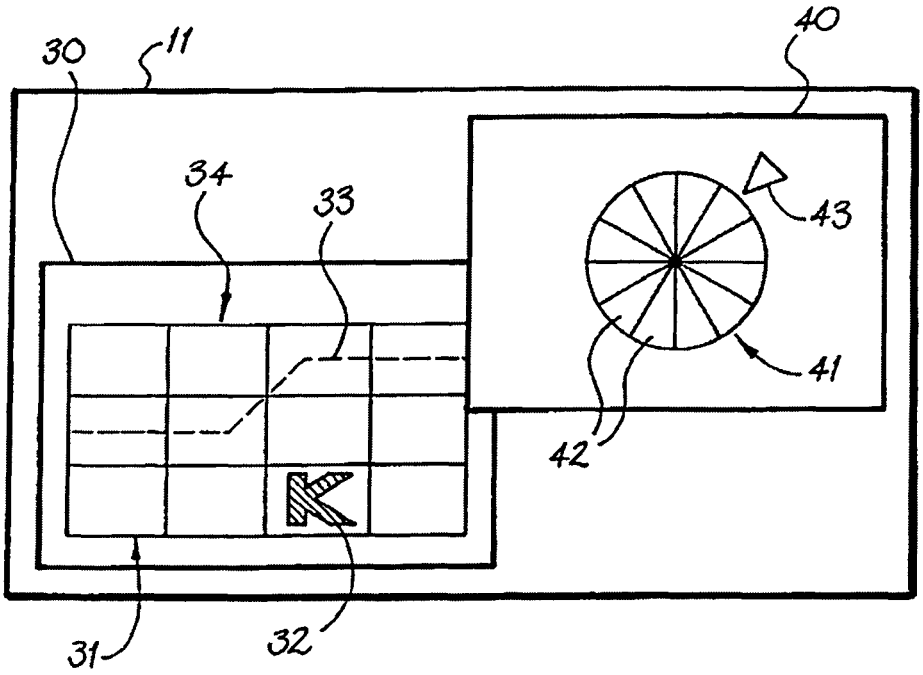
FIG. 3 shows a first game and a dynamic feature game.

FIG. 3 illustrates the video display screen 11 of FIG. 1 in more detail. In accordance with the present invention a first game is being played in a window 30 displayed on the video display screen 11, in this case being of a style which creates a matrix 31 of symbols and pays prizes for the occurrence of predetermined combinations in the matrix 31. In this embodiment, an occurrence of the symbol 'K' in position 32 constitutes the first trigger condition, causing a feature game to occur, in window 40. Although the feature game in the present embodiment appears on the same display means 11 as the first game, it is to be understood that the feature game may appear on a second display means of the console 10, or may even appear on a second console. Furthermore, embodiments of the invention may include a number of different first trigger conditions (for example, the occurrence of any one of a predetermined set of symbols in position 32), and the style of feature game occurring in window 40 may be dependent on which first trigger condition occurs.

The feature game shown in FIG. 3 is of a 'spinning wheel' style, in which a wheel 41 having a plurality of sectors 42 is activated such that it appears to spin. After a random amount of time, the wheel comes to a stop, and, if the sector 42 adjacent to the indicator 43 contains a prize, the feature game awards that prize. Both the first game and the feature game may be thematic, for example the spinning wheel may be represented as a spinning chocolate wheel and the spinning reel game (the first game) in window 30 may have a theme of a card game, for example the symbols representing the cards.

In accordance with the present invention, the controller 21 (see FIG. 2) includes a dynamic game feature wherein aspects of the feature game shown in window 40 are influenced by a second trigger condition of the first game shown in window 30. In the present embodiment, the second trigger condition is the occurrence of a winning combination along payline 33 in the first game shown in window 30. When the second trigger condition occurs, that is when a winning combination occurs along payline 33 in the first game being played in window 30 under the control of controller 21, an aspect of the feature game being played in window 40 is influenced. In the present embodiment, each winning combination along payline 33 causes an additional prize to be placed in a sector 42 which previously did not contain any prize. Alternatively, each sector 42 may contain a prize having a certain value, and the occurrence of the second trigger condition may cause the prize value in one or more of the sectors 42 to increase. The play of the feature game displayed in window 40 may constitute 'spinning' the wheel 41 until a sector stops adjacent to the indicator, or alternatively the indicator may be set in motion about the wheel until it comes to a stop adjacent to a sector. If the sector situated adjacent to the indicator contains a prize, the player is awarded that prize. The following examples are given to assist in the understanding of the invention and are not intended to be limiting.

Example 1

A first trigger condition starts a feature game in window 40. During 10 consecutive games played in window 30, each occurrence of a symbol of, say, a $100 note anywhere on column 34 of matrix 31 constitutes the second trigger condition, and has the effect of making one sector 42, out of say a possible 30 sectors, of the chocolate wheel 41 change from merely decorative form or from being a blank to a $100 note. At the end of the 10 games played in window 30 the player presses a button to activate the wheel 41 which is now made up of sectors containing $100 notes and sectors containing no prize. If the wheel stops with the indicator 43 indicating a sector 42 containing a $100 note, the prize is awarded.

Example 2

A first trigger condition causes 20 consecutive games to be played in window 30, during which each occurrence of a bonus symbol, or of a second trigger condition giving entry into a 2nd screen, or another condition causing the game to access a central 'link progressive' jackpot, or a trigger condition which starts a bonus game series, etc; will make one segment of the chocolate wheel 41 change from a blank to the bonus symbol. At the completion of the 20 games the player presses a button to activate the wheel spin. If the wheel 41 stops with the indicator 43 indicating a sector 42 containing a bonus symbol the bonus event or prize is awarded.

Example 3

A first trigger condition causes 10 games to be played in window 30, during which each occurrence of a "wheel symbol" anywhere in column 34 constitutes the second trigger condition, which will decrement the number of blank segments, say 30, of the wheel 41. The wheel 41 might have 15 blank sectors and 15 sectors containing $100 notes. After the 10 games are completed, the player presses a button to activate a random spin of the wheel 41, and if the wheel comes to stop with the indicator 43 indicating a sector 42 containing a $100 note, the player wins $100.

These examples could be implemented consecutively, or individually.

In the above described examples where blank or decorated sectors are changed to sectors which may provide a prize the player may be required to stake additional credit to effect that change, for example pay two credits to add a fifty credit prize to the wheel. Hence when the first trigger condition occurs the player will be taken to the feature screen where the second trigger condition will be the staking of additional credit by the player to build up the sectors of the wheel.

Figure 4:
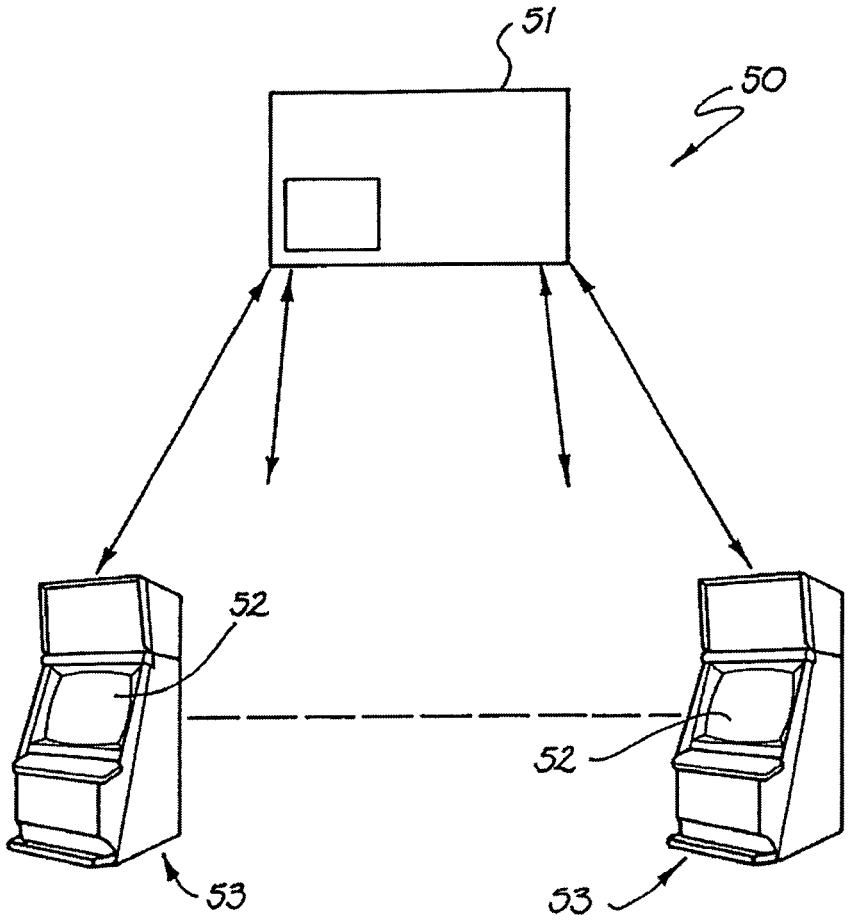
FIG. 4 illustrates a gaming system having a plurality of consoles.

As shown in FIG. 4 and in accordance with the second aspect of the invention, it is to be appreciated that the present invention may be implemented on a distributed gaming system 50, wherein a central gaming controller 51 controls display means 52 of a plurality of gaming consoles 53, or on other types of gaming systems.

Figure 5:
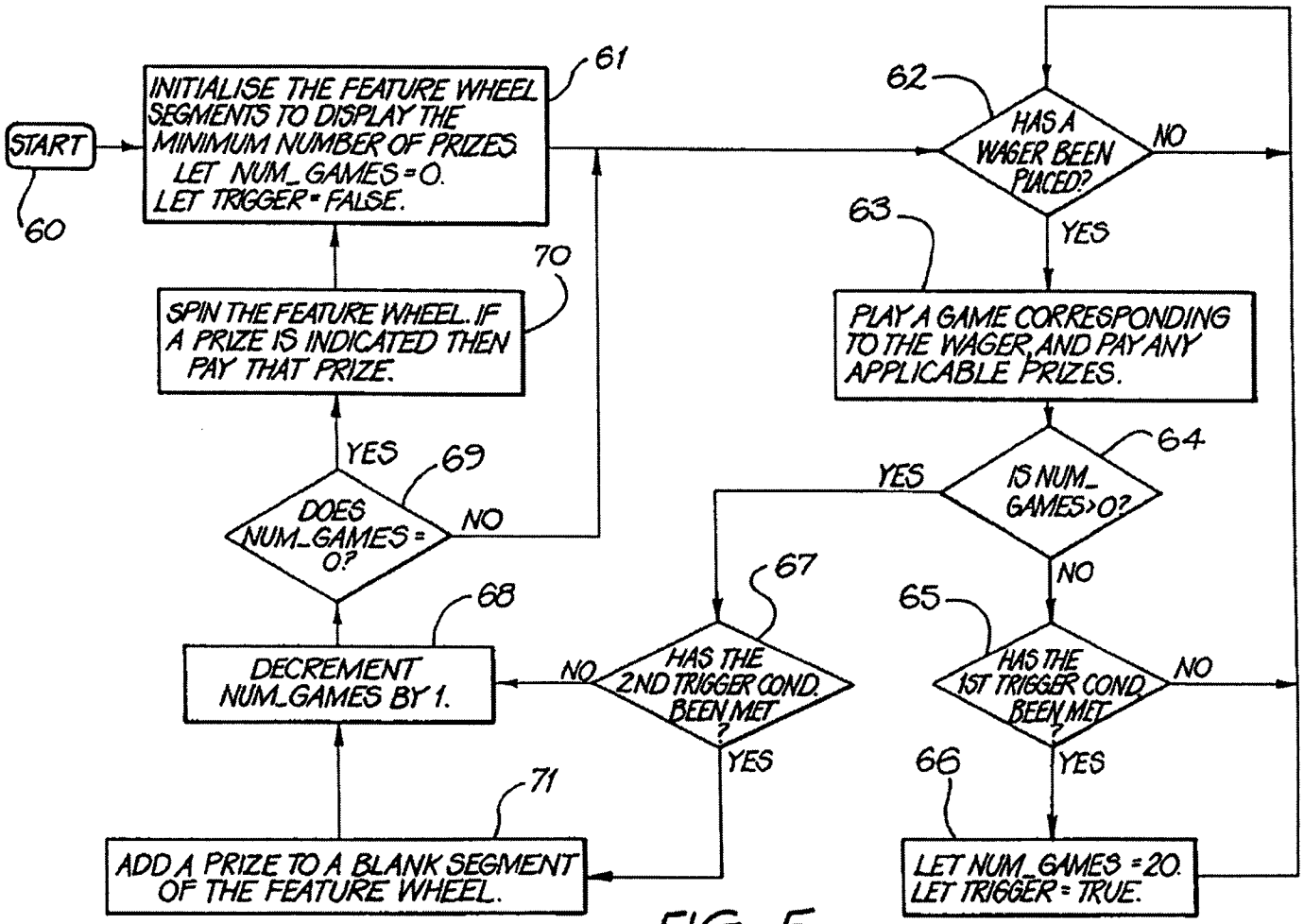
FIG. 5 is a flowchart illustrating the sequence of events of a second embodiment of the invention.

FIG. 5 is a flowchart illustrating the sequence of events of Example 2 of the invention, in which the first trigger condition arises during play of a base game, and the second trigger condition arises during play of a bonus game. During play of the base game, a sequence of events follows flowchart elements 60, 61, 62, 63, 64, 65 and 66. A sequence of events during a bonus game further includes flowchart elements 67, 68, 69, 70 and 71.

In more detail, it can be seen that following a start condition 60, initialisation of variables occurs during process 61. Gameplay then awaits placement of a wager at decision 62. Upon placement of a wager, a gameplay process 63 occurs. As can be seen, until a first trigger condition causes the variable NUM_GAMES to be set to a value of 20, the sequence of events of the base game will be caused by decision 65 to continue play of the base game, depending on placement of a wager as determined at decision 62.

Once a first trigger condition has occurred, the variable NUM_GAMES is set to a value of 20 at process 66, and when the first trigger condition is met at 65, twenty bonus games will commence. If the second trigger condition has occurred, then decision element 67 causes the sequence of events to proceed to process 71, in which a prize is added to a blank segment of the feature wheel, thereby increasing the likelihood of a winning outcome when feature gameplay occurs at 70. Flowchart element 69 prevents gameplay of the feature game from occurring until 20 bonus games have been played, during which time each occurrence of a second trigger condition causes a prize to be added to a blank segment of the wheel.

Figure 6:
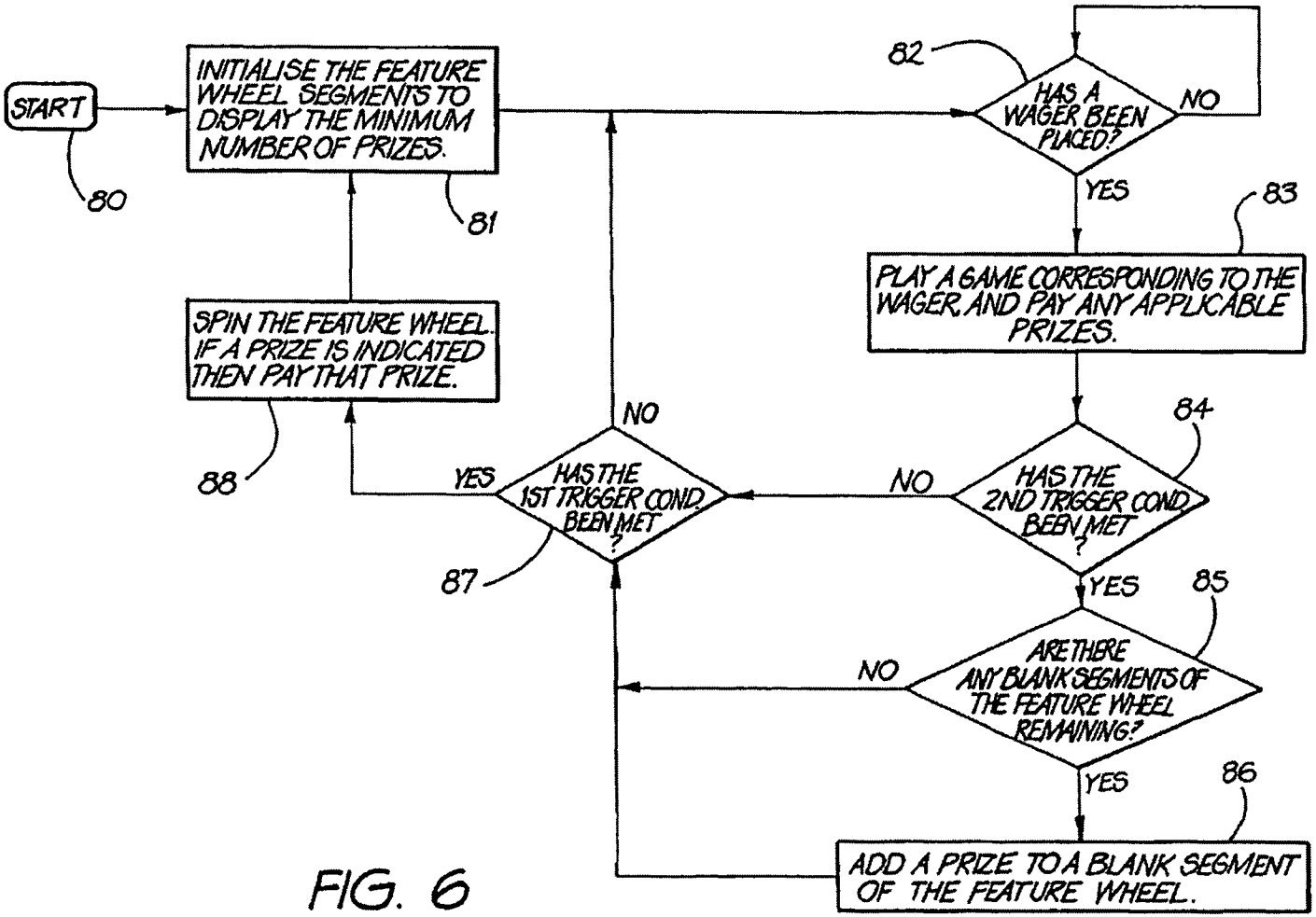
FIG. 6 is a flowchart illustrating the sequence of events of a third embodiment of the invention.

FIG. 6 is a flowchart illustrating the sequence of events in an additional embodiment of the invention, in which occurrence of both the first and second trigger conditions is determined during play of the base game (flowchart elements 80-87). As for the embodiment shown in FIG. 5, following a start condition 80, initialisation of variables and/or gameplay elements occurs at process 81. Commencement of the base game is dependent on placement of a wager, as shown at decision 82. Following play of the base game at process 83, a determination is made as to whether either the first trigger condition and/or second trigger conditions have occurred. If the second trigger condition has been met then process 86 causes a prize to be added to the wheel, increasing the likelihood of a winning outcome, at least until there are no blank segments remaining (decision 85). Following occurrence of the first trigger condition, decision 87 causes gameplay of the feature game to occur at process 88, in which the odds of winning will have been influenced by the number of times the second trigger condition has occurred prior to feature game play.

As will be evident, in the embodiment shown in FIG. 6, the second trigger condition may arise in either the base game or the bonus game.

Although the present invention has been described with reference to specific examples, it will be appreciated that it may be exemplified in other forms. For example, the idea of dynamically changing the segments of a wheel can also be applied to making up the segments of a board game. The elements of the board game, bonuses, etc will be awarded to a player as the result of landing on a position given the result of throwing dice (or a die) one or more times. Aspects of the feature game which may be influenced by the second trigger condition of the first game might include: the faces of a die or dice; the make up of a grid of squares such as bingo; the actual scorecard of a section of a game; or the make up of one or more spinning reels.

The feature game may be free or may be bought by the player in which case the player may be required to stake additional credit when playing the base in order to be eligible for the feature game. Typically the feature game will come about through chance, whether it is bought or free. Aspects of the feature game may be influenced by random events of the first game, user selections made in respect of the first game, random events occurring separately to the first game, or user selections made separately to the first game. The second trigger condition might even constitute a user selection of an aspect of the feature game, the user selection being made available upon the occurrence of the first trigger condition. In this instance, the user selection may be made on a display separate to the first game, for example in a separate display window, in which a player chooses say 10 out of 20 boxes to make up the feature game. The feature game could be any bonus game or series as are known in the art.

The feature game may commence immediately or may be conducted over a number of repetitions of the first game or may even be played at the player's discretion.

The first and/or second trigger conditions may occur in a basic game, or a separate bonus game.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming system for displaying a first game and a second game, comprising:

a credit input mechanism configured to accept a physical item representing a monetary value for credit input that establishes a credit balance to play at least the first game;

an operating mechanism operable by a player and configured to initiate play of the first game;

a video display operable to display the first game and the second game;

an electronic processor configured to, in accord with the established credit balance, cause the video display to display play of the first game, the first game comprising a plurality of first game outcomes, the first game outcomes comprising a plurality of game altering outcomes, determine if the first game outcomes include a game trigger outcome, in accord with the first game outcomes including a game trigger outcome, cause the video display to display play of a predefined number of plays of the first game and play of the second game including displaying on the video display a plurality of blank second game outcomes, cause the video display to display populating one or more of the plurality of blank second game outcomes with a prize amount for a prize winning outcome based on said game altering outcomes, initiate the second game after said predefined number of plays of the first game, and determine during said predefined number of plays of the first game one or more prize amounts for at least one of the plurality of second game outcomes to be awardable during play of said second game, and wherein an award is made in response to a populated second game outcome; and an output mechanism configured to cause a payout based on the value of the award made.

2. The gaming system as claimed in claim 1, and, wherein the electronic processor is further configured to cause the visual display the second game subsequent to at least one of the game trigger outcomes being displayed on the visual display.

3. The gaming system as claimed in claim 2, further comprising a first gaming machine cabinet housing the visual display and a second gaming machine cabinet housing a second visual display.

4. The gaming system as claimed in claim 2, further comprising a gaming machine cabinet housing the visual display and a second visual display.

5. The gaming system as claimed in claim 1, and wherein the electronic processor is further configured to cause the video display to display the first game in a first display window and the second game in a second display window concurrently with the first display window subsequent to at least one of the game trigger outcomes being displayed in the first display window.

6. The gaming system as claimed in claim 1, wherein the first game comprises a spinning reel game in which the game trigger outcome corresponds to a predetermined arrangement of at least one randomly selected symbol, and wherein the second game is a wheel based game comprising a circular object that is divided into a plurality of segments comprising at least one prize awarding segment that depicts a prize that can be awarded by the second game and at least one non-prize awarding segment that does not depict any prize that can be awarded by the second game, at least one of the game altering outcomes being such that when it causes the second game outcome to be populated, the at least one non-prize awarding segment is changed to depict a prize that can be awarded by the second game.

7. The gaming system as claimed in claim 1, and wherein one of the game altering outcomes comprises a probability for influencing a play aspect of the second game.

8. A method for displaying a first game and a second game in conjunction with a gaming system comprising a credit input mechanism configured to accept a physical item representing a monetary value for credit input that establishes a credit balance to play at least the first game, an output mechanism configured to cause a payout associated with the credit balance, an electronic processor, an operating mechanism operable by a player and configured to initiate play of the first game, a video display operable to display the first game and the second game, and a data storage device comprising game data, the method comprising:

processing, in response to the established credit balance, the game data to effect play of the first game and the second game, the first game comprising a plurality of first game outcomes, the first game outcomes comprising a plurality of game altering outcomes;

determining if the first game outcomes include a game trigger outcome;

in accord with the first game outcomes including a game trigger outcome, causing the video display to display play of a predefined number of plays of the first game and play of the second game including displaying on the video display a plurality of blank second game outcomes;

causing the video display to display populating one or more of the plurality of blank second game outcomes with a prize amount for a prize winning outcome based on said game altering outcomes;

initiating via the electronic processor the second game after said predefined number of plays of the first game;

determining via the electronic processor one or more prize amounts for at least one of the plurality of second game outcomes for selection during play of said first game to be awardable during play of said second game;

making an award in response to a populated second game outcome; and causing a payout via the output mechanism based on the value of the award made.

9. The method as claimed in claim 8, and further comprising displaying the second game on the visual display subsequent to at least one of the game trigger outcomes being displayed on the visual display.

10. The method as claimed in claim 9, and further comprising housing the first visual display in a first gaming machine cabinet and housing the second visual display in a second gaming machine cabinet.

11. The method as claimed in claim 9, and further comprising housing the first visual display and the second visual display in a gaming machine cabinet.

12. The method as claimed in claim 8, further comprising displaying the first game in a first display window and displaying the second game in a second display window concurrently with the first display window and subsequent to at least one of the game trigger outcomes being displayed in the first display window.

13. The method as claimed in claim 8, wherein at least one of the game altering outcomes comprises a value of a possible prize and the prize identifier populated to the second game outcome comprises a value of a prize that can be awarded by the second game.

14. The method as claimed in claim 8, wherein the first game comprises a spinning reel game in which at least one of the game trigger outcomes corresponds to a predetermined arrangement of at least one randomly selected symbol and at least one of the game altering outcomes corresponds to another predetermined arrangement of at least one randomly selected symbol, and wherein and the second game is a wheel based game comprising a circular object that is divided into a plurality of segments comprising at least one prize awarding segment that depicts a prize that can be awarded by the second game and at least one non-prize awarding segment that does not depict any prize that can be awarded by the second game, at least one of the game altering outcomes being such that when it causes the second game outcome to be populated the at least one non-prize awarding segment is changed to depict a prize that can be awarded by the second game.

15. The method as claimed in claim 8, and further comprising influencing the playing aspect of the second game by one of the game altering outcomes.

* * * * *